US006138622A

United States Patent [19]

Heer

[11] Patent Number: 6,138,622

[45] Date of Patent: Oct. 31, 2000

[54] DEVICE FOR ADJUSTING THE PHASE ANGLE OF A CAMSHAFT OF AN INTERNAL COMBUSTION ENGINE

[75] Inventor: Siegfried Heer, Kirchdorf/Krems, Austria

[73] Assignee: TCG United Aktiengesellschaft, Kirchdorf/Krems, Austria

[21] Appl. No.: 09/154,316

[22] Filed: Sep. 16, 1998

[30] Foreign Application Priority Data

| | | | |
|---|---|---|---|
| Sep. 19, 1997 | [AT] | Austria | 1586/97 |
| Aug. 6, 1998 | [AT] | Austria | 1358/98 |

[51] Int. Cl.[7] ..... F01L 1/344

[52] U.S. Cl. ..... 123/90.17; 123/90.31

[58] Field of Search ..... 123/90.15, 90.16, 123/90.17, 90.31; 74/568 R; 464/1, 2, 160

[56] References Cited

U.S. PATENT DOCUMENTS

| | | | |
|---|---|---|---|
| 3,978,829 | 9/1976 | Takahashi et al. | 123/90.15 |
| 4,967,701 | 11/1990 | Isogai et al. | 123/90.11 |
| 5,117,784 | 6/1992 | Schechter et al. | 123/90.17 |
| 5,293,845 | 3/1994 | Yamazaki et al. | 123/90.17 |
| 5,636,603 | 6/1997 | Nakamura et al. | 123/90.17 |
| 5,673,659 | 10/1997 | Regueiro | 123/90.17 |
| 5,680,837 | 10/1997 | Pierik | 123/90.17 |
| 5,860,328 | 1/1999 | Regueiro | 74/568 R |
| 5,979,382 | 11/1999 | Heer | 123/90.17 |

FOREIGN PATENT DOCUMENTS

| | | |
|---|---|---|
| 0234853 | 9/1987 | European Pat. Off. . |
| 3320835 | 12/1984 | Germany . |
| 3607256 | 9/1987 | Germany . |
| 3929619 | 3/1991 | Germany . |
| 4040486 | 1/1992 | Germany . |
| 4101676 | 7/1992 | Germany . |
| 4110088 | 7/1992 | Germany . |
| 2182736 | 5/1987 | United Kingdom . |
| 2221513 | 2/1990 | United Kingdom . |

*Primary Examiner*—Weilun Lo
*Attorney, Agent, or Firm*—Dykema Gossett PLLC

[57] ABSTRACT

A device for adjusting the phase angle of a camshaft of an internal combustion engine includes an adjusting mechanism which is operated by an electric motor, the latter being rigidly connected to the camshaft or the camshaft drive gear. Reliable adjustment is obtained in a simple manner by providing the adjusting mechanism as a planetary gear set.

15 Claims, 5 Drawing Sheets

DEVICE FOR ADJUSTING THE PHASE ANGLE OF A CAMSHAFT OF AN INTERNAL COMBUSTION ENGINE

BACKGROUND OF THE INVENTION

The invention relates to a device for adjusting the phase angle of a camshaft of an internal combustion engine, including an adjusting mechanism which is operated by an electric motor, the latter being rigidly connected to the camshaft or the camshaft drive gear.

DESCRIPTION OF THE PRIOR ART

To obtain optimum values for fuel consumption and exhaust emissions in different regions of the engine operating characteristics, the valve timing must be varied in dependence of different operating parameters. An elegant manner of varying the valve timing is realized by rotating the camshaft relative to its driving gear. The camshaft of an internal combustion engine usually is driven by a sprocket wheel, which is connected to the crankshaft via a drive chain, or a drive gear configured as a pulley, which is connected to the crankshaft via a toothed belt.

In DE 41 10 088 C1 and DE 39 29 619 A1 adjusting mechanisms are described where an adjusting element is provided between a member connected with the camshaft and a member connected with the drive gear, which element has two helical threads meshing with corresponding threads of the camshaft or the drive gear. By axially displacing this adjusting element the camshaft can be turned relative to its drive gear. Axial displacement of the adjusting element may be obtained by actuation of a hydraulic plunger which is operated in dependence of the desired adjustment. The disadvantage of this solution is that the forces required can only be attained with a large hydraulic plunger necessitating considerable constructional expense.

Moreover, a comparatively large amount of oil is required for operation of the plunger, which will necessitate a suitably sized pump and thus add to the engine load. As a further drawback of this known type of mechanism, adjustment of the camshaft is possible only between two extreme positions.

An electric adjusting device is presented in DE 41 01 676 A1, where an electric motor is provided for displacing the adjusting element by means of a threaded spindle. As the adjusting element rotates essentially at camshaft speed, an axial thrust bearing must be provided between the electric motor and the adjusting element, which takes up the relative movement between the non-rotating and the rotating member. In the above solution the thrust bearing is more or less permanently subject to load throughout the entire operating period, as the torsional moments acting between drive gear and camshaft will produce a force acting on the adjusting element in axial direction. For this reason the thrust bearing is a critical component which will limit the useful life of the engine.

In GB 2 221 513 A a camshaft adjusting mechanism is described, where an electric motor is provided which is rigidly connected to the sprocket driving the camshaft. The electric motor operates a threaded spindle carrying an adjusting element which is connected to the camshaft via a first set of link arms and to the sprocket via a second set of link arms. By activating the electric motor a turning of the camshaft relative to the sprocket may be effected in this way. This solution is expensive and requires considerable space.

In DE-A 36 07 256 a mechanism is described, where a stepping motor is provided for adjustment of the camshaft, which is rigidly connected to the drive gear. As the stepping motor must take up the entire driving torque required for the camshaft, such a solution must be abandoned for practical considerations.

U.S. Pat. No. 5,293,845 shows an adjusting mechanism for a camshaft, which is provided with a planetary gear set. A stationary electric motor is employed to effect a phase shift of the camshaft. Diasadvantageously, the transmission of force for driving the camshaft is effected via the rotating gears of the planetary gear set whose limited efficiency will entail certain losses. Moreover, the axis of the drive gear will be displaced in the course of the adjusting process, which will have to be compensated by means of complex tensioning mechanisms.

SUMMARY OF THE INVENTION

It is an object of this invention to provide a device which will not exhibit the disadvantages described above whilst ensuring safe and reliable adjustment of the camshaft phase angle in a simple manner. The device should require little space in order to permit independent adjustment of two camshafts positioned at a small axial distance.

In accordance with the invention this object is achieved by providing that the adjusting mechanism comprise a planetary gear set. The use of planet gears will eliminate the need for axially movable adjusting elements. As a consequence, the mechanical design will be simplified and a small overall size may be achieved. Another advantage of the invention is that any oil leakage will be safely prevented, so that the electric motor will be kept dry. To ensure emergency operation in case of a breakdown of the adjusting mechanism, it is generally provided that the camshaft driving torque should ensure that an extreme position is reached in which safe operation of the engine is still possible.

The planetary gear set preferably has a large reduction ratio, i.e., preferably greater than 1:8, or even more preferably, greater than 1:12. At such a ratio self-locking of the mechanism can be achieved if necessary, i.e., at least approximately. In this way the electric motor is subject to no load, or to minimum load only, during normal operation of the engine, when no adjustment takes place. This will increase the useful life of the engine and diminish the required energy expense.

It is provided in a particularly advantageous variant of the invention that the electric motor and an internally toothed gear of the planetary gear set be rigidly connected to the drive gear. Preferably, the planet carrier of the planetary gear set is rigidly connected to the camshaft. In this instance the output shaft of the electric motor is connected to the sun gear of the planetary gear set. A comparatively large gear reduction can be achieved in this manner.

A further variant of the invention, which is given particular preference, proposes that the planetary gear set should comprise only an internally toothed gear and a planet carrier supporting a single planet gear. No sun gear is provided in such a planetary gear set. Preferably, the number of teeth of the planet gear is only slightly fewer than the number of teeth of the internal gear, i.e., preferably by one. This implies that the axis of the planet gear is only slightly displaced relative to the axis of the internal gear. As a consequence, several teeth of these gears are in mesh simultaneously, which will lead to a favourable load situation.

Such a device may thus be given a most compact design permitting two camshafts to be adjusted independently even within small distance. In addition, a large step-down ratio is achieved in this way, which is desirable in view of the required size of the electric motor.

It will be an advantage if the electric motor is rigidly connected to the camshaft and the planet gear is connected to the drive gear by means of a synchronizing coupling. The synchronizing coupling, which may be configured as an Oldham coupling, for example, will compensate the axial displacement between planet gear and drive gear.

As an alternative, the proposal is put forward that the electric motor should be rigidly connected to the drive gear and that the planet gear should be connected to the camshaft by means of a synchronizing coupling.

A particularly favourable arrangement is achieved by configuring the planet carrier as output shaft of the electric motor, with an eccentric piece on which the planet gear is supported.

Accurate control of the adjusting angle is achieved by configuring the electric motor as a stepping motor.

The present invention also relates to an internal combustion engine that is provided with a device as described above.

DESCRIPTION OF THE DRAWINGS

The invention will now be described further, by way of example, with reference to the accompanying drawings, in which.

DESCRIPTION OF PREFERRED EMBODIMENTS

Figure 1:
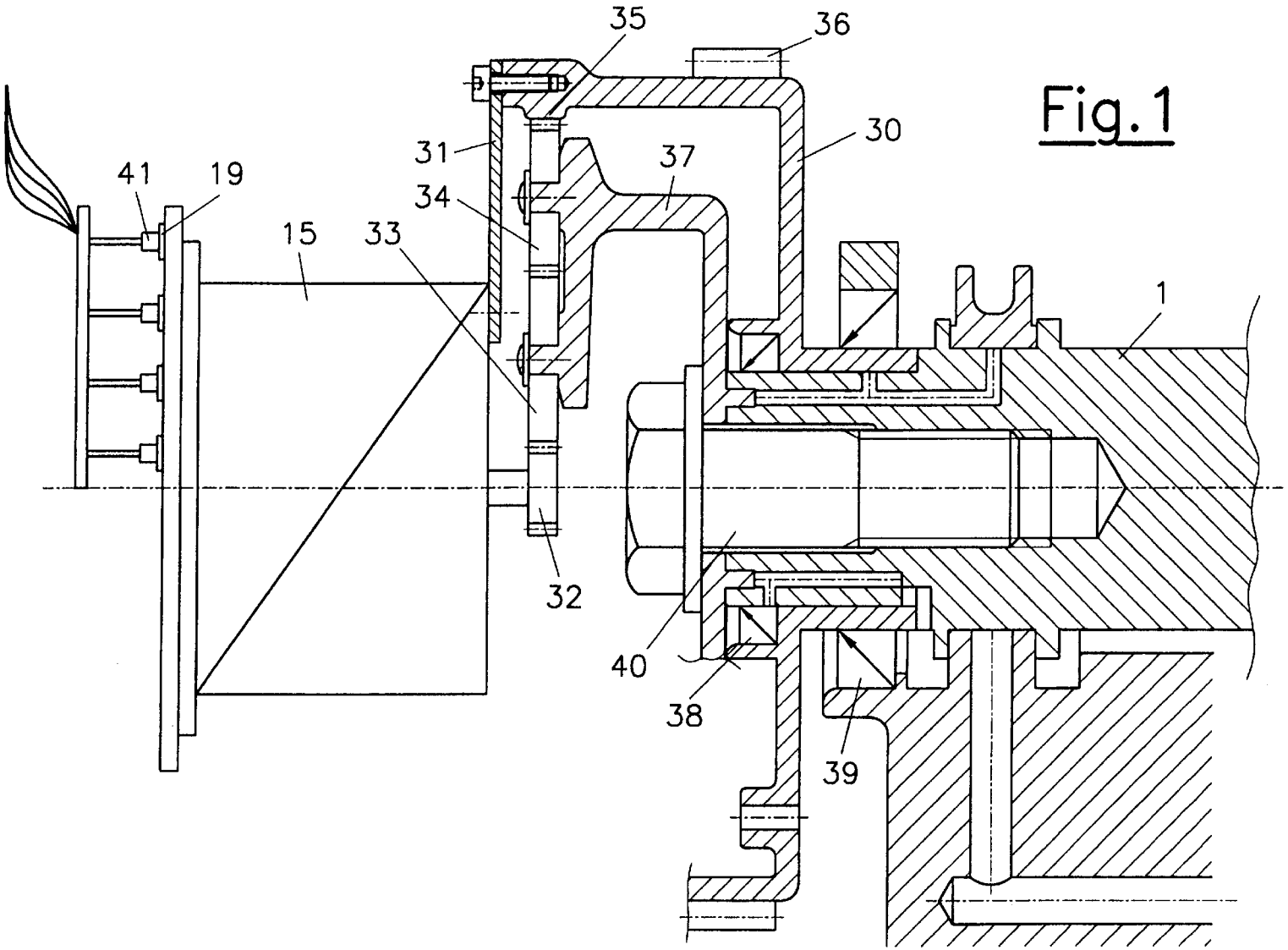
FIG. 1 is a longitudinal section of a first variant of the invention.

A first variant of the invention is presented in FIG. 1. On a camshaft 1 a support 30 is mounted so as to be rotatable but axially immovable. The outer circumference of the support 30 is provided with teeth 36, which are designed to engage a toothed belt driving the camshaft 1, and will thus constitute the drive gear. The support 30 further carries a plate 31 to which an electric motor 15 is rigidly attached. The electric motor 15 rotates together with the drive gear 36. Further provided are slip rings 19 which are supplied with electric current by stationary contacts 41. Via planet gears 33, 34 the pinion 32 of the electric motor 15 meshes with a hollow gear, i.e., an internally toothed gear 35, which latter is configured integral with the support 30. A planet carrier 37, which supports the planet gears 33, 34, is rigidly connected to the camshaft 1. When the electric motor 15 is not energized, the pinion 32 is at a standstill relative to the motor 15, and pinion 32 and planet carrier 37 will rotate at the speed of the drive gear 36; as a consequence, the camshaft 1 will also rotate at the same speed. By energizing the electric motor 15 a relative movement of the planet carrier 37 against the drive gear 36 can be effected. Due to the comparatively large step-up ratio of the planetary gear set, the large torques required for adjustment of the camshaft 1 can be supplied with a comparatively low-power electric motor 15. Sealing of the system against the oil chamber in the area of the camshaft 1 is effected by means of rotary shaft seals 38, 39. A screw 40 is used to fasten the planet carrier to the camshaft 1.

To achieve maximum accuracy in adjusting the phase angle of the camshaft 1, the planetary gear set consisting of gears 32, 33, 34, 35 may be configured in a known manner in such a way as to exclude any play. For quiet operation the gears 32 to 35 may be made of high-resistance plastic material.

Figure 2:
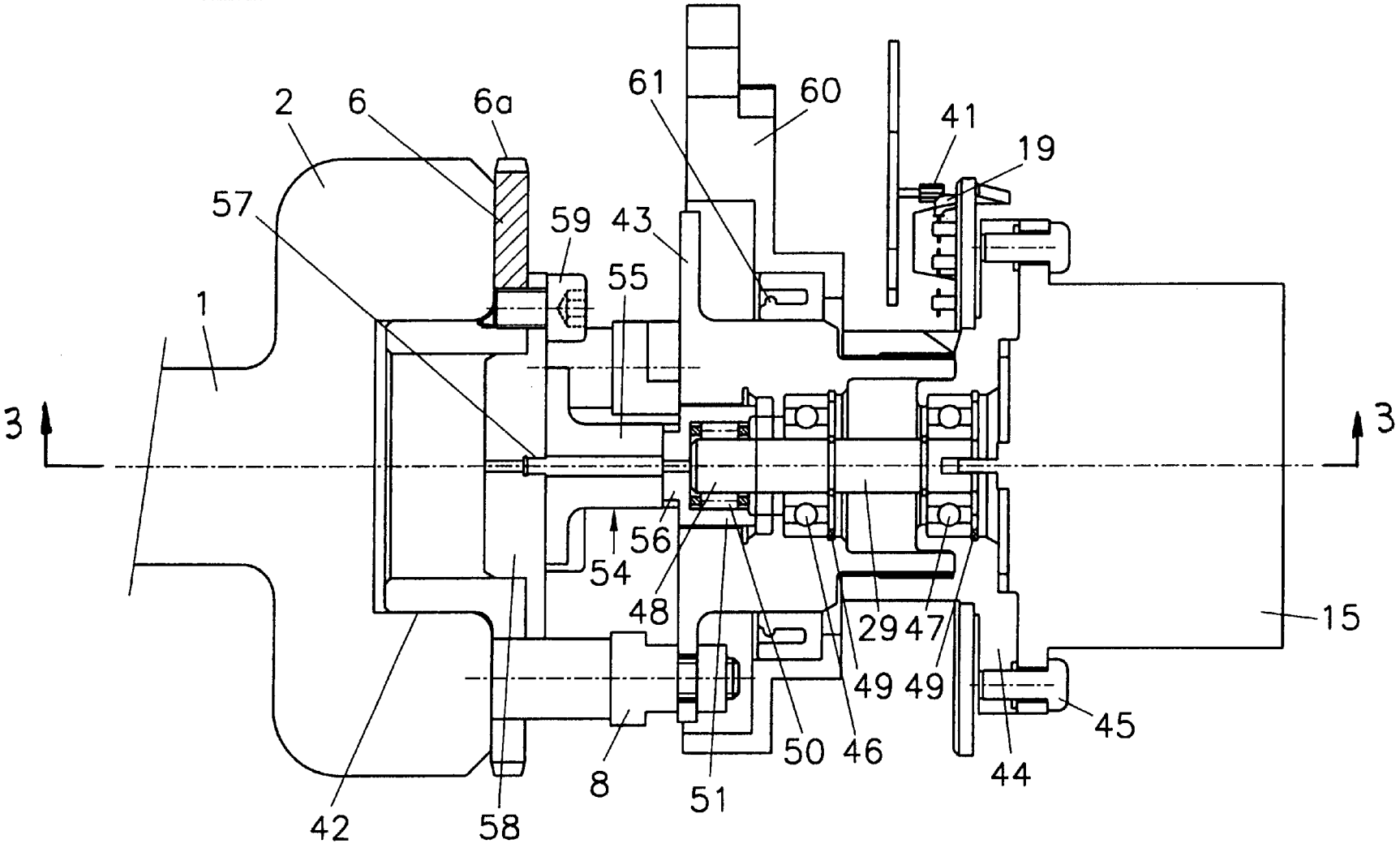
FIG. 2 a longitudinal section of a further variant of the invention.

In the variant of FIG. 2 the camshaft 1 has a flange 2 at its end. Via a plain bearing 42 the flange 2 supports a drive gear 6 for the camshaft 1, which gear 6 is provided with teeth 6a on its circumference for engaging a drive chain not shown in this drawing. By means of threaded bolts 8 a support 43 is fastened to the flange 2. The threaded bolts 8 pass through openings 10 in the drive gear 6, which are configured as arc-shaped, oblong holes. In this manner the angular range of adjustment of the camshaft 1 will be defined. On the support 43 is mounted a nut 44 carrying an electric motor 15 attached by screws 45. As in the above variant the electric motor 15 is supplied with current by means of slip rings 19 and contacts 41.

The output shaft 29 of the electric motor 15 rests on the support 43 and the nut 44 via rolling bearings 46 and 47; at its distant end facing away from the motor 15 the shaft 29 exhibits an eccentric piece 48. The rolling bearings 46 and 47 are held in place axially by snap rings 49. On the eccentric piece a planet gear 51 is supported by means of a needle bearing 50, which meshes with an internally toothed gear 52 provided in one piece with the support 43. A thrust plain bearing bush 53 secures the planet gear 51 in axial direction.

Figure 3:
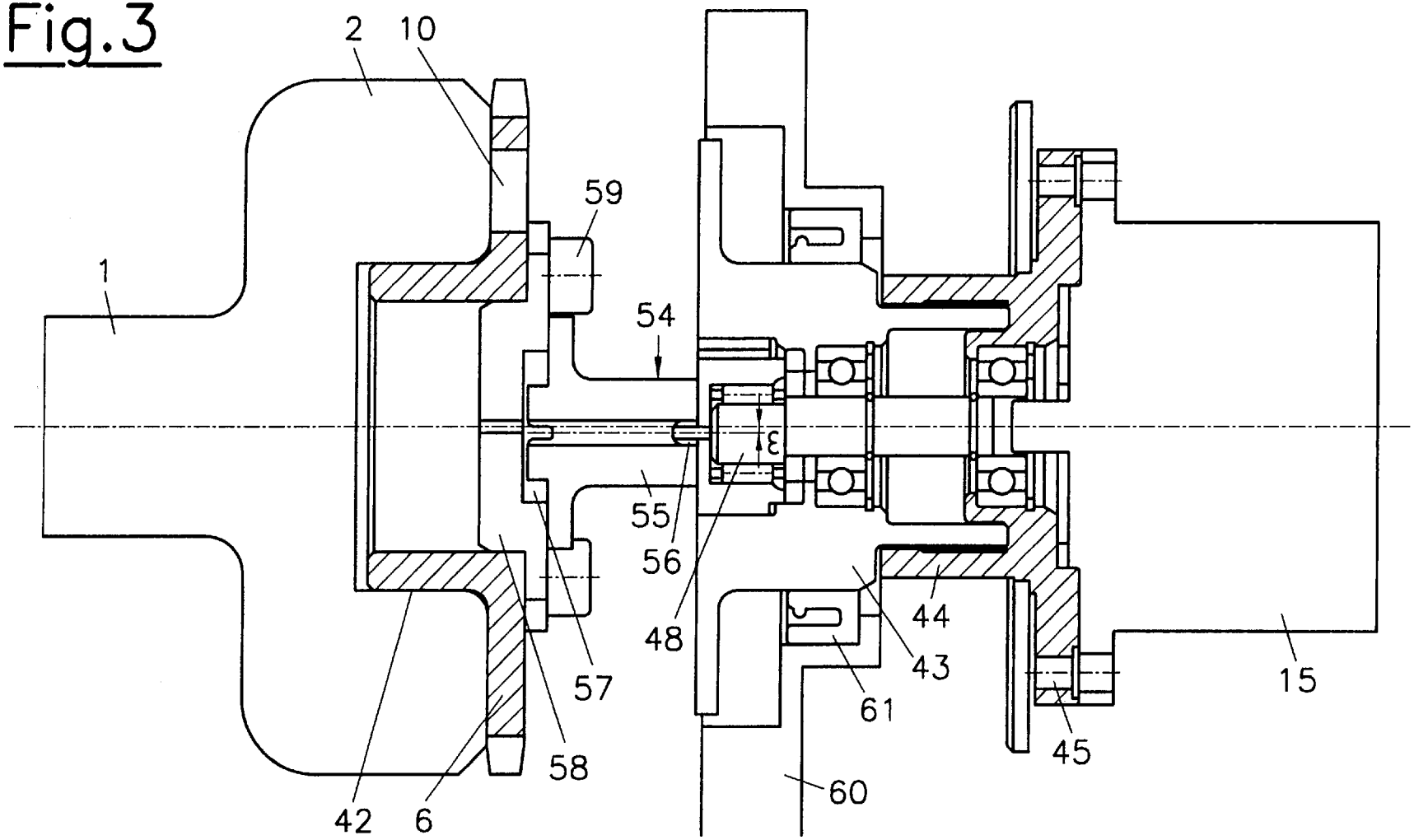
FIG. 3 shows the variant of FIG. 2 in a section along line 3—3 in FIG. 2, omitting some components for the sake of clarity.
Figure 4:
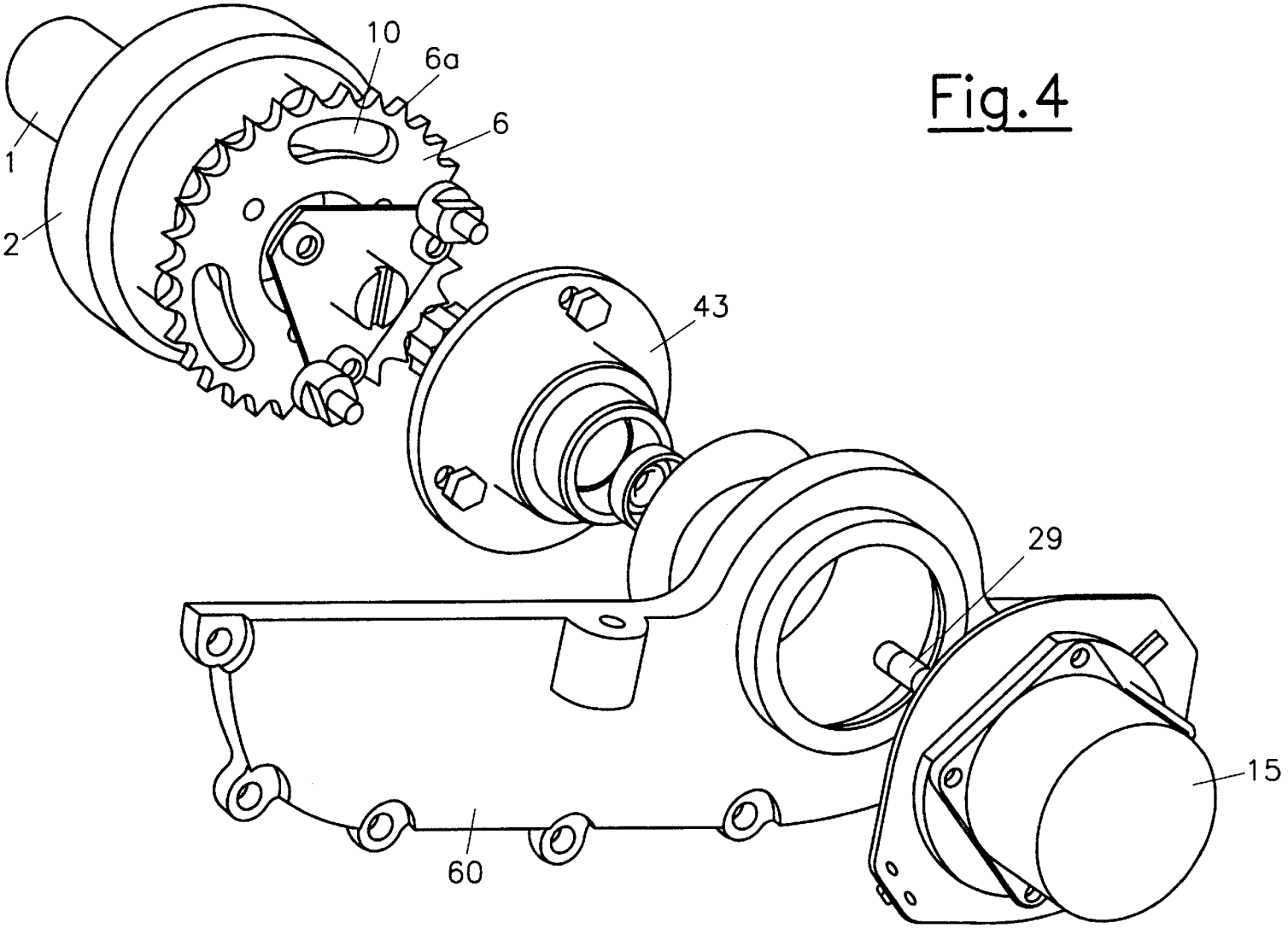
FIG. 4 is an exploded view of the variant of FIGS. 2 and 3.

The planet gear 51 is rotatably connected to the drive gear 6 by means of a so-called Oldham coupling 54 constituted by a synchronizing universal joint. The Oldham coupling 54 is provided with an engaging element 55 which is connected to the planet gear 51 via a sliding guide 56 permitting limited movement of the engaging element 55 relative to the planet gear 51 in the plane of FIG. 2. The engaging element 55 is further connected to an adapter 58 of the drive gear 6 via another sliding guide 57 permitting limited movement of the engaging element 55 relative to the drive gear 6 in the plane of FIG. 3. It is thus possible to transmit the driving torque from the drive gear 6 to the planet gear 51, the eccentricity $\epsilon$ being compensated. Screws 59 connect the adapter 58 to the sprocket 6 and at the same time secure the engaging element 55.

A housing 60, which is sealed against the support 43 by a rotary shaft seal 61, separates the components on the engine side, i.e., camshaft 1, Oldham coupling 54 and the planetary gear set, from the components that are not wetted by oil, such as the electric motor 15.

Figure 5:
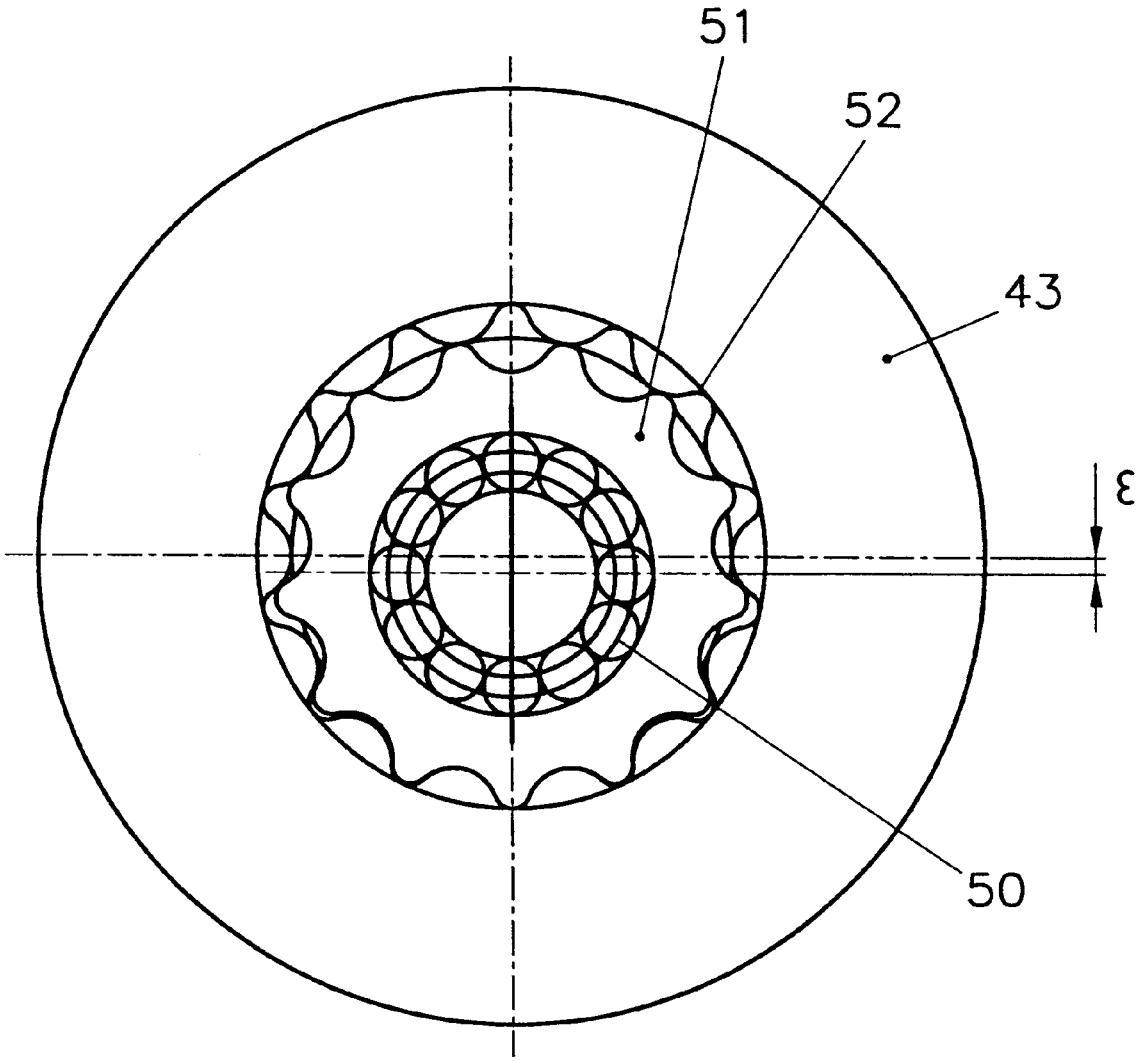
FIG. 5 shows a detail of this variant.

FIG. 5 shows the layout of the planetary gear set. The internally toothed gear 52 in the support 43 exhibits fourteen teeth whilst the planet gear 51 has thirteen teeth. At the point opposite of the point of meshing, the tip circle of the planet gear 51 approximately touches the tip circle of the internally toothed gear 52. In this way about half of all teeth are in constant mesh, thus reducing the load on the tooth flanks. For this reason the planetary gear set may have a very compact design. Moreover, a rotation of the output shaft 29 of the electric motor 15 will effect only one thirteenth of a revolution of the planet gear 51 relative to the electric motor 15, such that the load on the electric motor will also be minimized.

The present invention will permit variation of the valve timing in an internal combustion engine in a simple and reliable manner. As a special advantage, it will permit selection of any intermediate positions desirable.

What is claimed is:

1. Device for adjusting the phase angle of a camshaft of an internal combustion engine, comprising an adjusting mechanism which is operated by an electric motor, said electric motor being rigidly connected to the camshaft and being supplied with power via slip contacts, wherein the adjusting mechanism comprises a planetary gear set consisting of an internally toothed gear and a planet carrier supporting a single planet gear, said planet gear including teeth fewer in number by one than a number of teeth of the internally toothed gear.

2. Device as claimed in claim 1, wherein the planetary gear set has a reduction ratio, greater than 1:8.

3. Device as claimed in claim 1, wherein the planetary gear set has a reduction ratio, greater than 1:12.

4. Device as claimed in claim 1, wherein the planetary gear set is self-locking.

5. Device as claimed in claim 1, wherein the electric motor is rigidly connected to the camshaft and the planet gear is connected to the drive gear by means of a synchronizing coupling.

6. Device as claimed in claim 1, wherein the planet carrier is configured as part of the output shaft of the electric motor, which is provided with an eccentric piece on which the planet gear is supported.

7. Device as claimed in claim 1, wherein the electric motor is a stepping motor.

8. Internal combustion engine including a device as claimed in claim 1.

9. Device for adjusting the phase angle of a camshaft of an internal combustion engine, comprising an adjusting mechanism which is operated by an electric motor, said electric motor being rigidly connected to the camshaft and being supplied with power via slip contacts, wherein the adjusting mechanism comprises a planetary gear set consisting of an internally toothed gear and a planet carrier supporting a single planet gear, wherein the planet carrier is configured as part of the output shaft of the electric motor, which is provided with an eccentric piece on which the planet gear is supported.

10. Device as claimed in claim 9, wherein the planetary gear set has a reduction ratio greater than 1:8.

11. Device as claimed in claim 9, wherein the planetary gear set has a reduction ratio greater than 1:12.

12. Device as claimed in claim 9, wherein the planetary gear set is self-locking.

13. Device as claimed in claim 9, wherein the electric motor is a stepping motor.

14. Internal combustion engine including a device as claimed in claim 9.

15. Device as claimed in claim 9, wherein the planetary gear includes teeth only slightly fewer in number than a number of teeth of the internally toothed gear.

* * * * *

UNITED STATES PATENT AND TRADEMARK OFFICE

CERTIFICATE OF CORRECTION

PATENT NO. : 6,138,622
DATED : October 31, 2000
INVENTOR(S) : Siegfried Heer

It is certified that error appears in the above-identified patent and that said Letters Patent is hereby corrected as shown below:

Title page,
Item [73] Assignee: TCG Unitech Aktiengesellschaft, Kirchdorf/Krems, Austria Signed and Sealed this Second Day of October, 2001

*Attest:*

Nicholas P. Godici

NICHOLAS P. GODICI
*Acting Director of the United States Patent and Trademark Office*

*Attesting Officer*